United States Patent [19]

Pitzer et al.

[11] 4,449,701

[45] May 22, 1984

[54] TUYERE FOR THE INJECTION OF GASES INTO A METALLURGICAL VESSEL

[75] Inventors: Ken Pitzer, New Castle; James F. Cunningham; Jai Pearce, both of Pittsburgh, all of Pa.

[73] Assignee: Pennsylvania Engineering Corporation, Pittsburgh, Pa.

[21] Appl. No.: 410,312

[22] Filed: Aug. 23, 1982

[51] Int. Cl.[3] ..... C21C 5/48

[52] U.S. Cl. ..... 266/218; 266/270; 266/266; 75/60

[58] Field of Search ..... 266/218, 224, 225, 266, 266/270, 282, 283; 239/591; 75/59, 60, 93 E; 264/86, 60

[56] References Cited

U.S. PATENT DOCUMENTS

| | | | |
|---|---|---|---|
| 3,346,190 | 10/1967 | Shepherd | 75/60 |
| 3,817,505 | 6/1974 | Le Roy et al. | 266/266 |
| 4,272,286 | 6/1981 | Schempp | 75/60 |

FOREIGN PATENT DOCUMENTS

| | | | |
|---|---|---|---|
| 995688 | 6/1965 | United Kingdom | 266/225 |

*Primary Examiner*—L. Dewayne Rutledge
*Assistant Examiner*—Robert L. McDowell
*Attorney, Agent, or Firm*—Fred Wiviott

[57] ABSTRACT

A tuyere for use in a metallurgical vessel comprising a first pipe adapted to be affixed to the wall of a metallurgical vessel and having a first end extending through the refractory lining of the vessel and a second end extending outwardly therefrom. A gas inlet member is affixed to the second end of the pipe and the second pipe is affixed to the gas inlet member and extends inwardly through the first pipe. The outer diameter of the second pipe is smaller than the inner diameter of the first pipe to provide a gap there between. Means are provided between the first and second pipes to maintain them in spaced-apart relation and the interior of the first pipe is filled with a material such as refractory.

7 Claims, 2 Drawing Figures

TUYERE FOR THE INJECTION OF GASES INTO A METALLURGICAL VESSEL

BACKGROUND OF THE INVENTION

This invention relates to tuyeres for metallurgical vessels.

In metallurgical vessels such as basic oxygen furnaces, oxygen is injected into a molten metal bath, such as pig iron, through a top lance for the purpose of oxidizing carbon, silicon, and other impurities. In order to promote homogeneity of the molten metal bath, inert gases such as argon, nitrogen, or carbon dioxide are injected through bottom tuyeres so as to promote mixing.

Such prior art bottom tuyeres have generally comprised a pipe opening into the lower end of the vessel. Inert gas was then discharged through the pipe into the molten metal bath thereby inducing motion in the bath which resulted in mixing. It has been found that when a single tuyere pipe is employed, gas flow at the center of the pipe tends to be greater than along its inner surface whereby the cooling effect of the gases with respect to the tuyere pipe is diminished. As a result, the tuyere pipes tend to become relatively hot resulting in rapid tuyere and refractory wear.

SUMMARY OF THE INVENTION

It is an object of the invention to provide new and improved tuyeres for metallurgical vessels.

A further object of the invention is to provide a new and improved tuyere for injecting inert gases into a metallurgical vessel.

Yet another object of the invention is to provide a new and improved tuyere for metallurgical vessels wherein cooler operation is achieved, thereby extending tuyere and refractory life.

These and other objects and advantages of the invention will become apparent from the detailed description thereof taken with the accompanying drawings.

In general terms the invention comprises a tuyere comprising a first pipe, a second pipe and means for fixing the first pipe to the wall of a metallurgical vessel with one end of the first pipe extending inwardly into the vessel and the opposite end extending away from the vessel, the second tuyere pipe has an outer diameter less than the inner diameter of the first tuyere pipe and means are provided for securing the second pipe within the first pipe to define an annular passage there between. Gas inlet means are coupled to the annular passage and refractory means are disposed within the inner pipe and filling the same.

DETAILED DESCRIPTION OF THE PREFERRED EMBODIMENT

Figure 1:
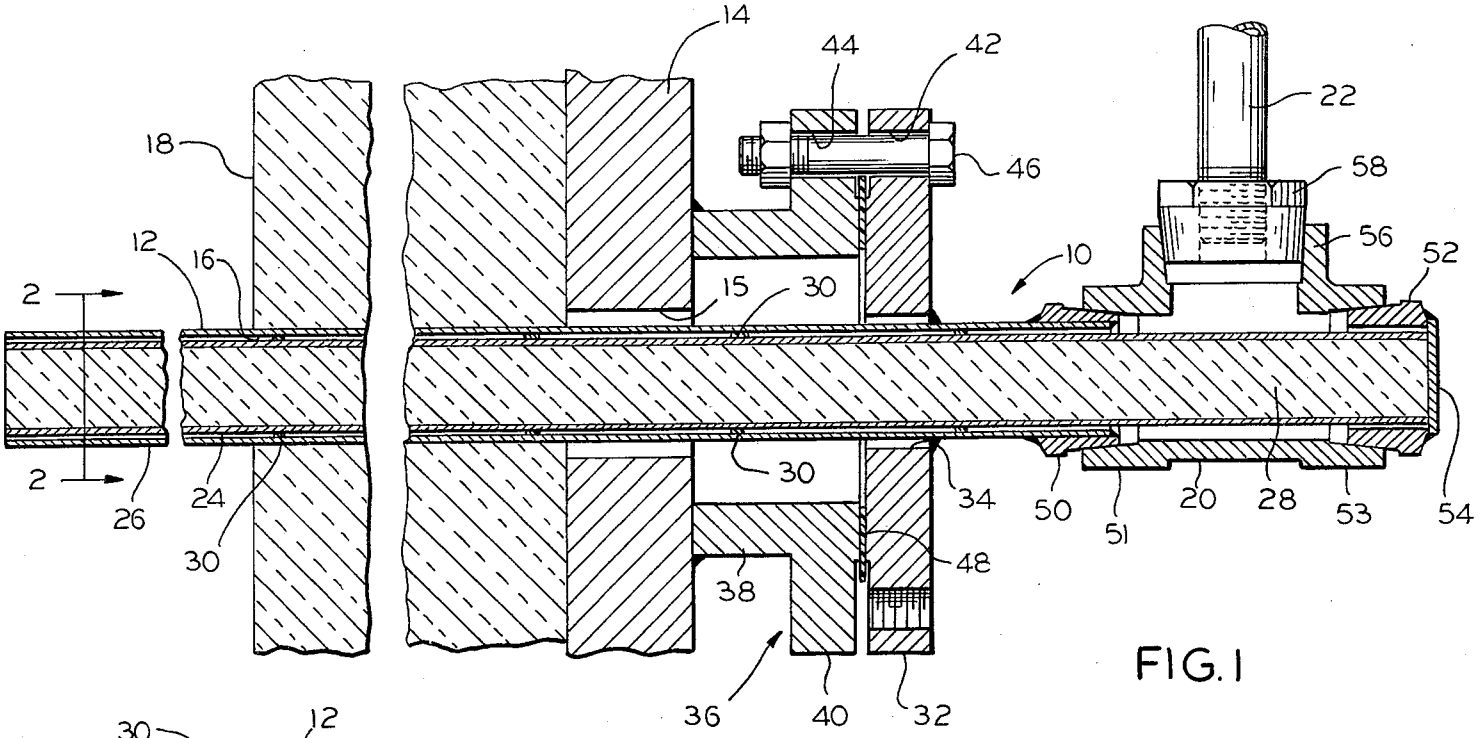
FIG. 1 is a sectional view of a tuyere according to the preferred embodiment of the present invention.
Figure 2:
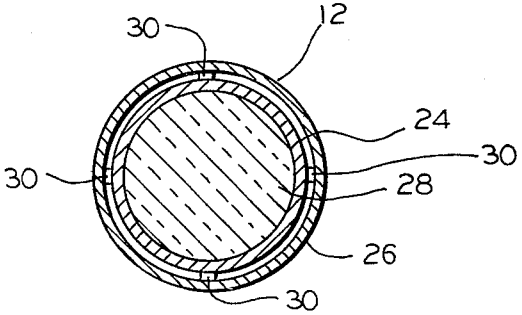
FIG. 2 is a view taken along lines 2—2 of FIG. 1.

The tuyere 10, according to the preferred embodiment of the invention, is shown in FIGS. 1 and 2 to include a first tuyere pipe 12 adapted to be mounted on the outer metallic shell 14 of the metallurgical vessel for being inserted through a first opening 15 in the shell 14 and a second, concentric opening 16 in the refractory vessel lining 18. A gas coupling 20 is affixed to the outer end of the pipe 12 for being connected by a pipe 22 to a source of inert gas.

A second tuyere pipe 24 is affixed to the gas coupling 20 and extends coaxially through the first pipe 12. The outer diameter of the second tuyere pipe 24 is less than the inner diameter of the first tuyere pipe 12 so that a gap 26 exists there between. As seen in FIG. 2, the pipes 12 and 24 are each generally circular in transverse cross-section so that the gap 26 is annular with the diameter of the pipes 12 and 24 being relatively large in relation to the distance of cross-gap 26. The interior of the second tuyere pipe 24 is filled with a refractory material 28 and suitable spacers 30 are affixed in spaced-apart relation to its outer surfaces whereby the pipes 12 and 24 are maintained in a spaced apart relation and the gap 26 is maintained in a preselected cross-section area along the length of the pipes 12 and 24.

The first tuyere pipe 12 is affixed to the vessel shell 14 by means of a circular flange plate 32 which has a central opening 34 disposed concentrically around pipe 12 and suitably affixed thereto such as by welding. A mounting member 36 which includes a short cylindrical section 38 suitable affixed to the vessel shell 14 such as by welding and a concentric surrounding relation to the opening 15. The opening 16 is formed by drilling and is preferably sized to receive the pipe 12.

The member 36 also includes an integral mounting flange 40 extending radially from its opposite end. The flange plate 32 and the flange 40 are complimentary and each have a plurality of aligned openings 42 and 44 respectively whereby the two may be releasably secured by bolts 46. An annular, gas impervious gasket 48 is preferably disposed between the flange plate 32 and the flange 40.

The flange plate 32 is affixed intermediate the ends of the first pipe 12 whereby a first end extends inwardly through the openings 15 in the vessel shell 14 and 16 in the refractory lining 18. A second end of the pipe 12 extends from the opposite side of the flange plate 32 and there is a first coupling means which takes the form of an annular bushing member 50, suitable secured thereto such as by welding. The gas coupling 20 comprises a T-section having tapered pipe threads at each of its opposite ends. One end of the T-coupling is threaded on the tapered external thread formed on the first bushing member 50 while a second coupling means which takes the form of an annular bushing member 52, is threadably received at the opposite ends thereof. An end plate 54 is affixed such as by welding to the outer end of the bushing 52 and the second tuyere pipe 24 is affixed to the inner surface of plate 54 so that the second tuyere pipe 24 is fixed against axial movement relative to the first tuyere pipe 12. In addition, there is an inlet 56 in the gas coupling 20 which extends radially from its mid section and has internal threads for receiving a pipe fitting 58 which in turn receives one end of inlet pipe 22.

As those skilled in the art will appreciate, the inlet pipe 22 is connected to a suitable source of inert gas such as argon, nitrogen or carbon dioxide and which is delivered through the annular gap 26 between the tuyere pipes 12 and 24. As a result, the gas flow is maintained along the surface of the pipes 12 and 24 to promote cooling and thereby increase tuyere and refractory life. In addition, replacement of the tuyere 10 can be accomplished merely by removing the bolts 46 and withdrawing the entire assembly.

While only a single embodiment of the invention has been illustrated and described, it is not intended to be limited thereby but only by the scope of the appended claims.

We claim:

1. A tuyere for injecting a non-oxidizing gas into a metallurgical vessel comprising a first tuyere pipe, means for fixing said first tuyere pipe to the wall of a metallurgical vessel with one end of said pipe extending inwardly into said vessel and the opposite end extending away from said wall, a second tuyere pipe disposed within said first tuyere pipe and having an outer diameter less than the inner diameter of the first tuyere pipe, first means for securing said second tuyere pipe against axial movement relative to said first tuyere pipe, second means disposed between said pipes for maintaining the same in a spaced apart relation and to define a gap therebetween, gas inlet means coupled to said gap, and refractory material disposed within said inner tuyere pipe and filling the same whereby gas introduced at said gas inlet means flows through said gap and adjacent the walls of the first and second tuyere pipes for cooling the same as said gas is introduced into said vessel.

2. The tuyere set forth in claim 1 and including first coupling means affixed to the opposite end of said first tuyere pipe, said gas inlet means being secured to said first coupling means.

3. The tuyere set forth in claim 2 and including a second coupling means releasably secured to said gas inlet means, said second tuyere pipe being secured to said second coupling means.

4. The tuyere set forth in claim 3 wherein each of said coupling means comprises an annular member, said gas inlet means comprising a T-section having one end connected to said first coupling means and said second coupling means being connected to the opposite end of said T-section 5. The tuyere set forth in claim 4 and includng an annular flange secured to the outer surface of said first tuyere pipe and extending radially therefrom for being releasably affixed to the metallic shell of said vessel.

6. The tuyere set forth in claim 5 wherein one end of said second tuyere pipe is affixed to plate means, said plate means being affixed to said second coupling means for maintaining said second pipe within said first pipe.

7. The tuyere set forth in claims 1, 2 or 3 wherein the first and second tuyere pipes are circular in transverse section and said gap is generally annular, the diameters of said tuyere pipes being large in relation to the distance across said gap.

* * * * *